US009151160B1

(12) United States Patent
Poll

(10) Patent No.: US 9,151,160 B1
(45) Date of Patent: Oct. 6, 2015

(54) HYDRAULIC MOTOR FOR GENERATING ELECTRICITY

(76) Inventor: Enrique Poll, Miami, FL (US)

( * ) Notice: Subject to any disclaimer, the term of this patent is extended or adjusted under 35 U.S.C. 154(b) by 841 days.

(21) Appl. No.: 13/449,843

(22) Filed: Apr. 18, 2012

(51) Int. Cl.
*F01B 23/10* (2006.01)
*F01B 23/08* (2006.01)

(52) U.S. Cl.
CPC ..... *F01B 23/08* (2013.01); *F01B 23/10* (2013.01)

(58) Field of Classification Search
CPC ..... F01B 23/10; F01B 23/08; Y02E 10/226; Y02E 10/30
See application file for complete search history.

(56) References Cited

PUBLICATIONS http://www.bakercorp.com/pdfs/BKR_WhitePaper_WaterHammer.pdf.

*Primary Examiner* — Nathaniel Wiehe
*Assistant Examiner* — Abiy Teka
(74) *Attorney, Agent, or Firm* — Christian Sanchelima

(57) ABSTRACT

A hydraulic motor for generating electricity with a water holding container with a conduit extending downwardly to a distribution valve assembly. A hydraulic shock valve assembly connected to a port in the conduit, adjacent to the distribution valve assembly, periodically imparts a shock to the water entering the distribution valve assembly with some water collected by a holding tank. The distribution valve assembly permits the water to go through to move a piston assembly. The moving valve member quickly moves from two end positions a spring loaded actuating mechanism that is unstable when the distal end of the valve rod reaches a predetermined position. The piston assembly also actuates as a wheel assembly that in turn drives an actuating valve assembly driving the hydraulic shock valve assembly and an electric generator that in turn powers a pump to bring water from the holding tank to the container.

5 Claims, 15 Drawing Sheets

HYDRAULIC MOTOR FOR GENERATING ELECTRICITY

BACKGROUND OF THE INVENTION

1. Field of the Invention

The present invention relates to a hydraulic motor and, more particularly, to such a motor that converts the kinetic energy of a body of liquid into electrical energy.

2. Description of the Related Art

Several designs for electricity-generating hydraulic devices have been designed in the past. None of them, however, include a mechanism that uses the water hammer effect (or hydraulic shock) of a moving liquid to activate an electric generator. See The effects to hydraulic shock, in many instances, have adverse effects such as the possible implosion of water pipes. To alleviate this effect pressure relied valves or slow closing valves are used. The present invention, on the other hand, uses the hydraulic shock effect to enhance the force applied to piston assembly 40 to generate a reciprocating motion to drive the rest of the elements. There are no hydraulic motors that utilize this effect to generate electric energy as described and claimed herein.

SUMMARY OF THE INVENTION

It is one of the main objects of the present invention to provide a hydraulic motor that will efficiently convert the kinetic energy of a body of water into electricity without using combustible fuel and without being affected by the elements or the weather.

It is another object of this invention to provide such a mechanism in a volumetrically efficient manner to achieve the desired output at any time and it can be installed anywhere. The water is recycled and used continuously.

It is yet another object of this invention to provide such a device that is inexpensive to manufacture and maintain while retaining its effectiveness and it can be used with multiple hydraulic shock assemblies having one shared tank.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
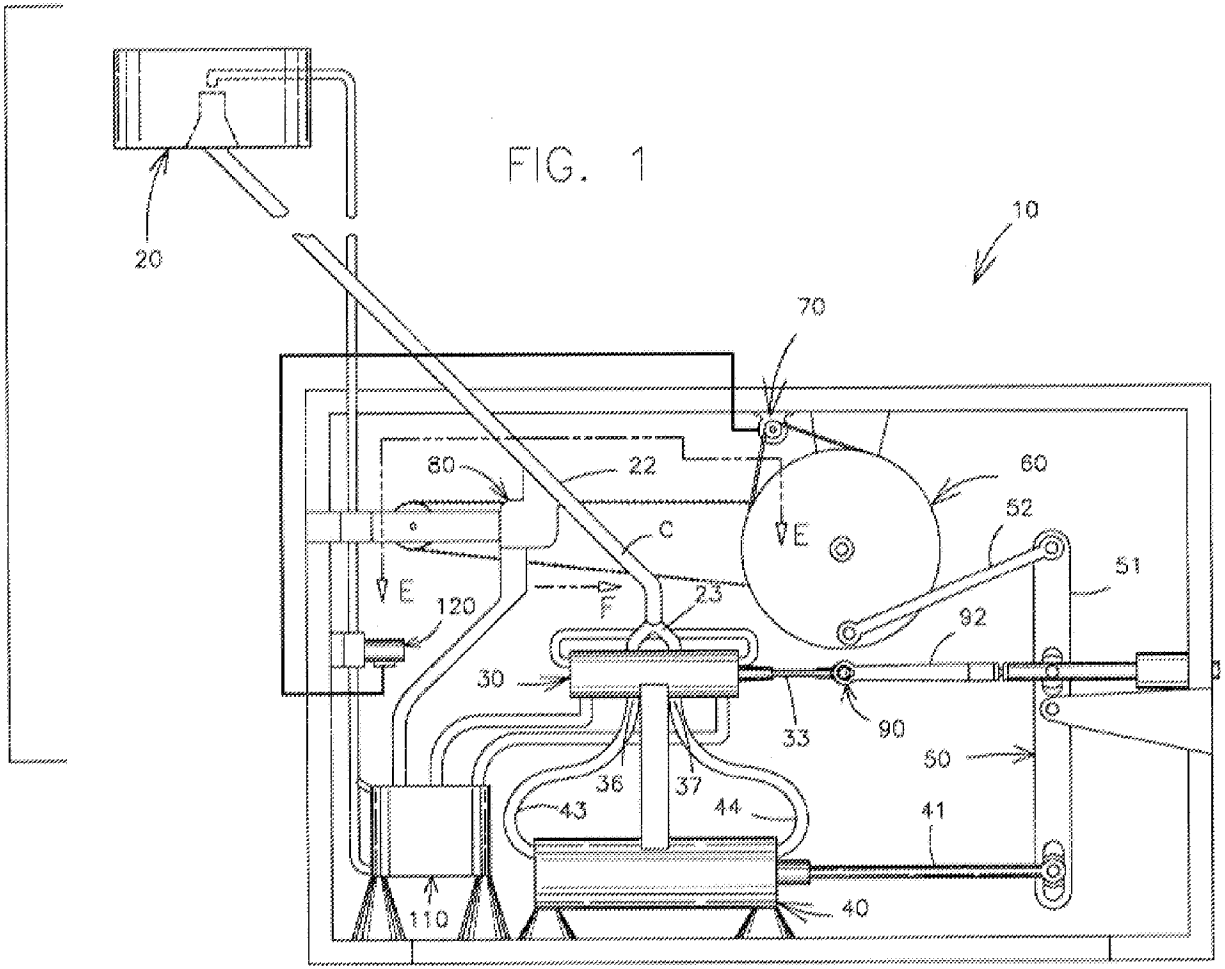
FIG. 1 represents an elevational view of the different components used in an embodiment for the present invention.
Figure 2:
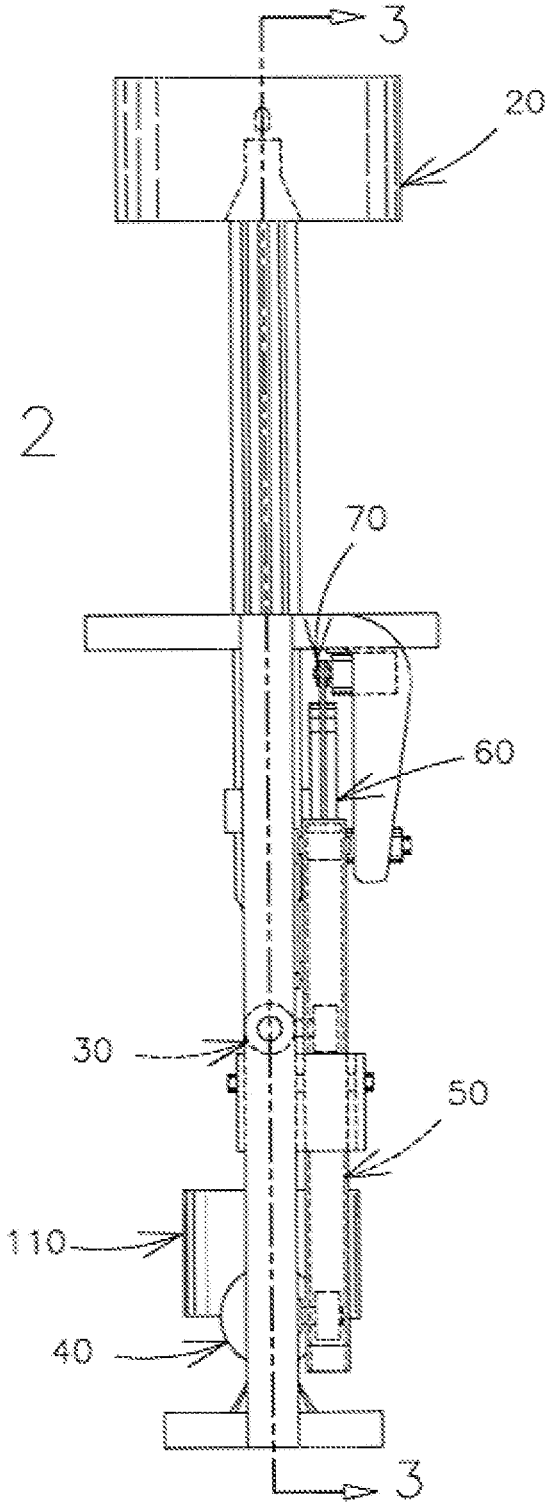
FIG. 2 is a side elevational view of the embodiment represented in the previous figure.

Referring now to the drawings, where the present invention is generally referred to with numeral 10, it can be observed that it basically includes container assembly 20 holding a predetermined amount of a liquid (preferably water) connected through conduit assembly 22 at end 21 and to distribution valve assembly 30 at end 21*a* and to hydraulic shock valve assembly 80. Assembly 30 is connected to piston assembly 40 through conduit 25, which in turn transmits its reciprocating movement to lever assembly 50 that causes wheel assembly 60 to rotate and eventually impart rotational movement to generator 70. Distribution valve assembly 30 is connected to conduit assembly 22, which in turn is connected to container 20 at its lowermost point at a cooperative location through bifurcated tube 23. Hydraulic shock valve assembly 80 is also connected to conduit assembly 22 at connecting port 24. Assembly 80 is preferably adjacent to valve assembly 30. Inlet/outlet ports 36; 37 are connected to piston assembly 40. Distribution valve assembly 30 includes moving valve member 32 and valve rod 33. Valve member 32 includes transversal through opening 32*a* that comes in alignment with inlet port 36*a* and inlet/outlet port 36 in one extreme position. In the other extreme position, inlet port 37*a* comes in unobstructed alignment through opening 32*a* with and inlet/outlet port 37. Rod 33 is mechanically coupled to pivoting lever member 51 of lever assembly 50 for sudden reciprocating of moving valve member 32. The reciprocating movement is suddenly imparted by spring mechanism 90. It is important for this spring mechanism 90 to cause sudden movements of valve member 32. To cause piston rod 41 of assembly 40 to move between its two extreme positions (left and right in this application), water enters and exits through conduits 43; 44 to and from ports 43*a* and 44*a*, as best seen in FIG. 1. Piston assembly 40 discharges the water to holding tank 110 through outlet ports 35 and 38 of valve assembly 30. Shock valve assembly 80 also discharges water in holding tank 110 through conduit 116. Pump assembly 120 sends the water from tank 110 back to container 20. Assembly 120 is powered by generator 70.

Figure 3:
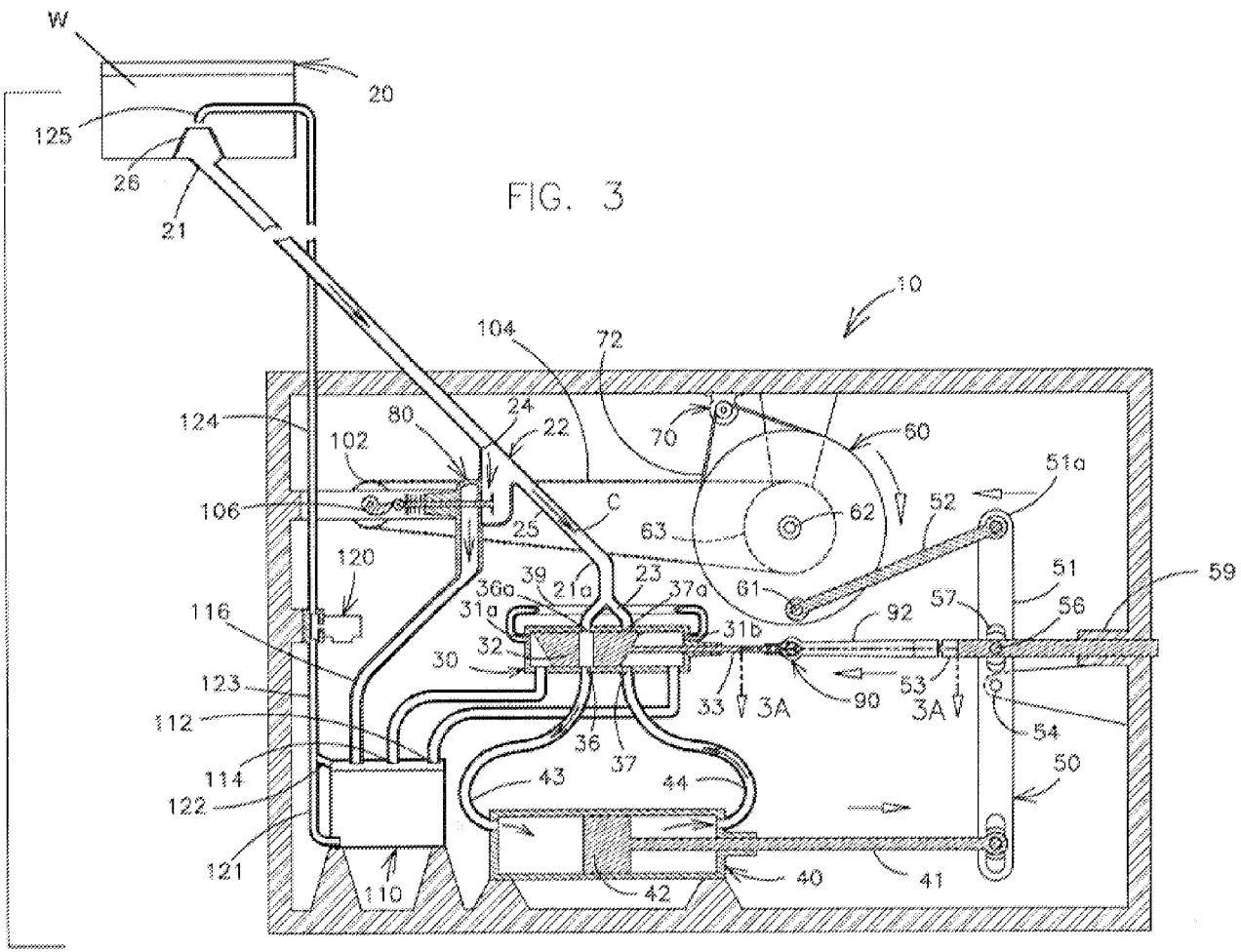
FIG. 3 shows an elevational cross-sectional view taken along line 3-3 of the embodiment shown in the previous figure with hydraulic shock valve assembly 80 in the open position and pivoting lever member 51 in the vertical position. Distribution valve assembly 30 is shown in the leftmost position.

In one of the operational embodiments, a body of water W is collected in container assembly 20 and a column of water C is formed inside conduit assembly 22. The energy of water column C is totally potential energy when it does not move. When the water moves down through water conduit 22, it acquires kinetic energy ($\frac{1}{2}$ $mV^2$), which increases when a hydraulic shock appears thereby exerting a considerably greater force against piston head 42, as best seen in FIG. 3. The force (pressure times area) is proportional to the area of water column C (more mass) and its velocity while inversely proportional to the valve closing time.

The force from water column C is going to be increased by the action of hydraulic shock valve assembly 80. And it will be applied repetitively. This amplified force will be distributed by distribution valve assembly 30 to piston assembly 40. The latter imparts a reciprocating movement to lever assembly 50 that in turn is converted to a rotational movement of wheel assembly 60. Assembly 60 drives generator 70 through belt 72 to produce electricity. The column of water C is also discharged onto holding tank 110 through valve assembly 30 and shock valve assembly 80. The water is removed from tank 110 by pump assembly 120. As the water is removed from tank 110 through conduits 121 and 122, a partial vacuum develops on the upper part of tank 110, facilitating the removal of the water from piston assembly 40 and from hydraulic shock valve assembly 80. Facilitating the removal of the water from valve assembly 80 improves the water shock action since it increases the speed of water in conduit assembly 22. This will translate to more force applied to piston assembly 40.

Figure 3A:
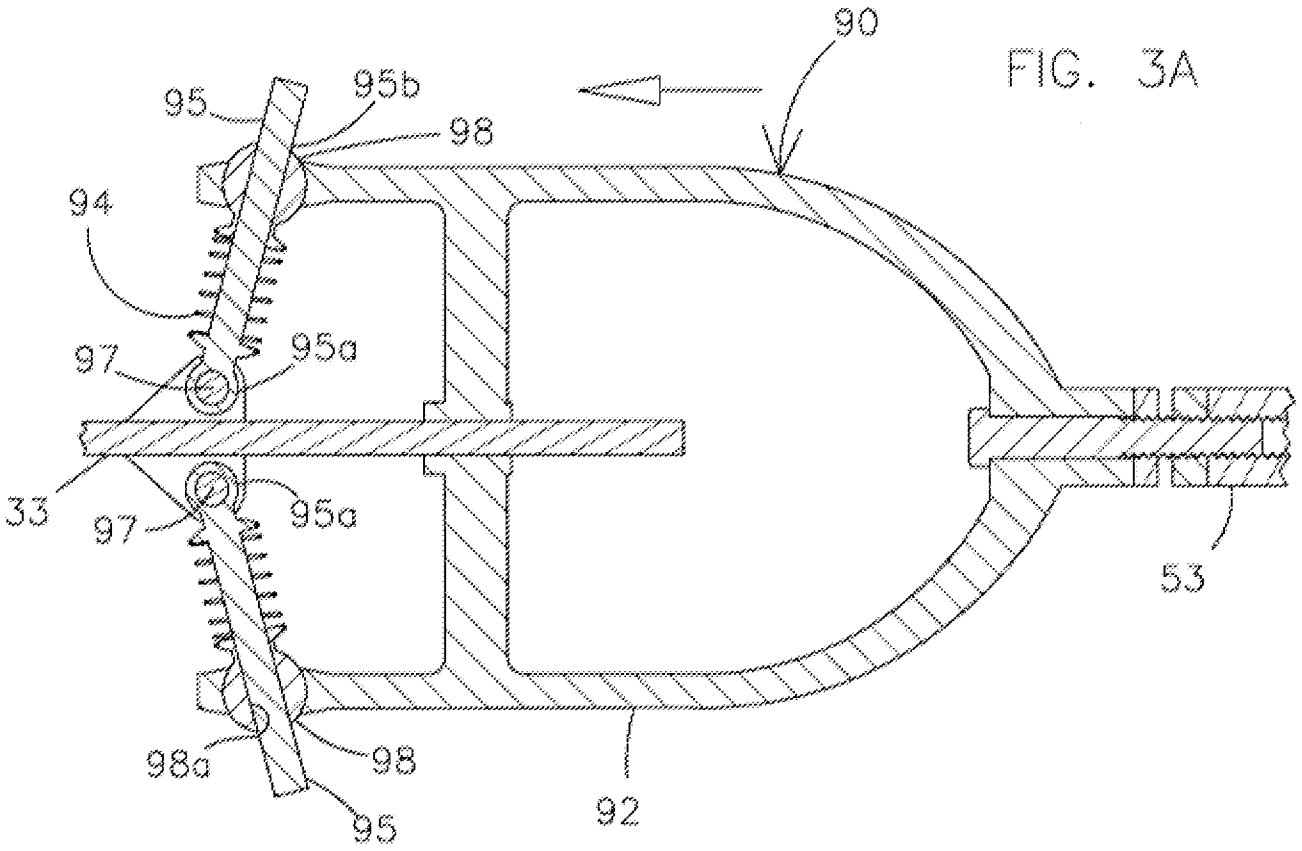
FIG. 3A represents a cross-sectional view of spring mechanism 90 along lines 3A-3A in FIG. 3 showing a portion of linkage rod 52 and the components of spring mechanism 90. Spring mechanism 90 is traveling towards the leftmost position.
Figure 4:
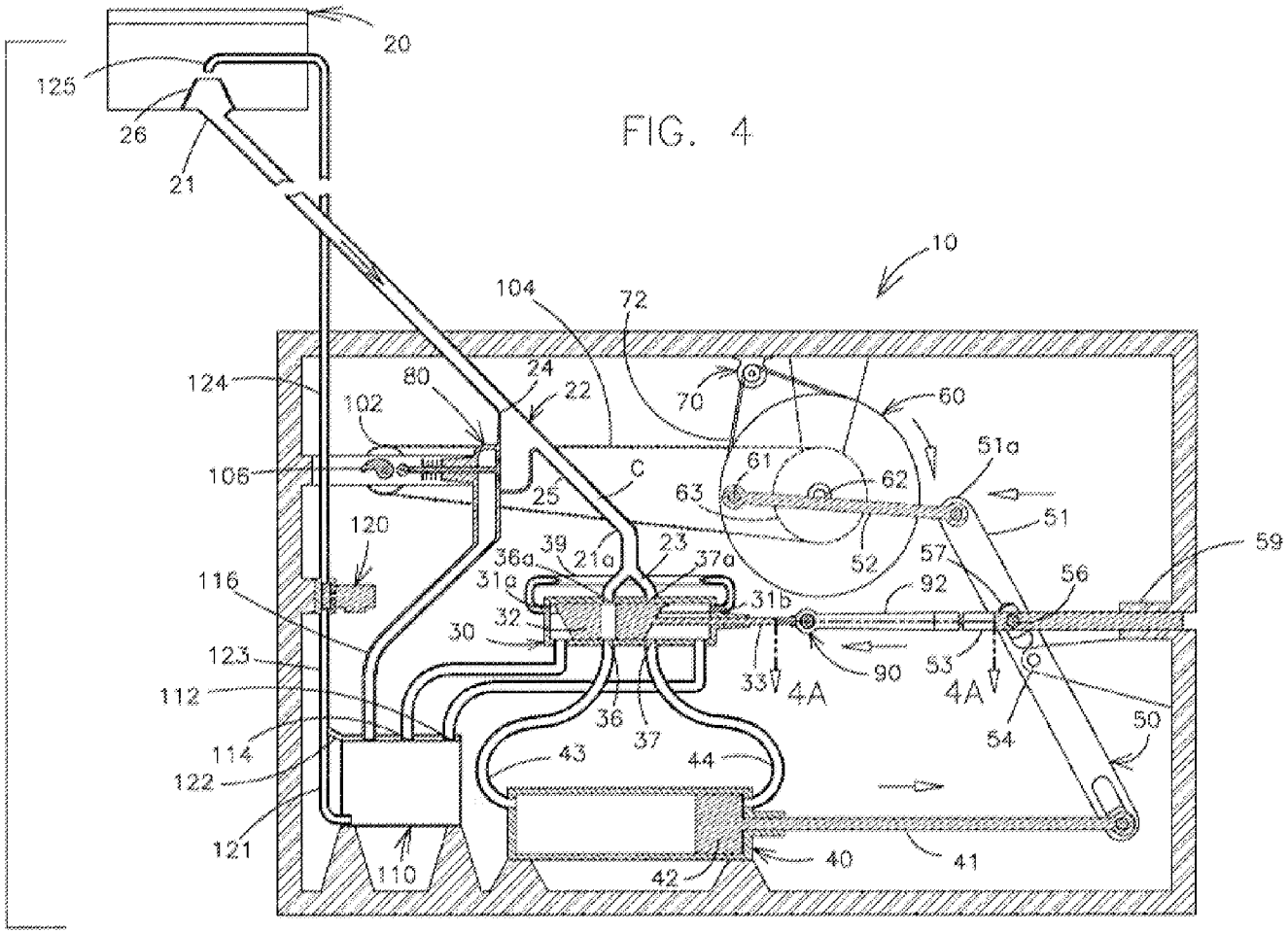
FIG. 4 illustrates another elevational cross-sectional view with pivoting lever member 51 inclined at the position just before spring mechanism 90 is activated. Piston head 42 is shown about to reach its rightmost position.
Figure 4A:
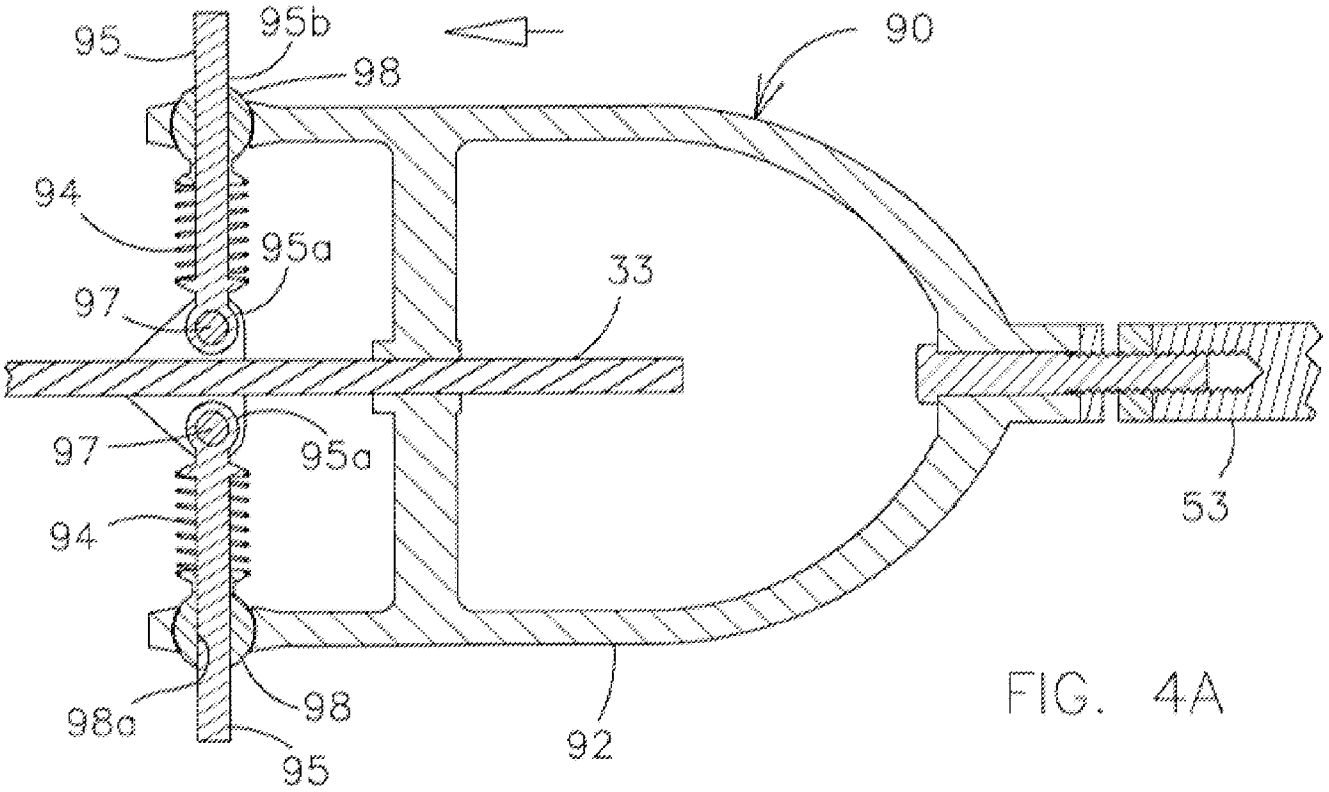
FIG. 4A is a representation of spring mechanism 90 with spring members 94 in coaxial alignment and ready to be fired. Spring mechanism 90 is about to stop moving to the left to reach its leftmost position. Valve rod 33 is about to be drastically pushed to the right by the expansion of spring mechanism 94.
Figure 5:
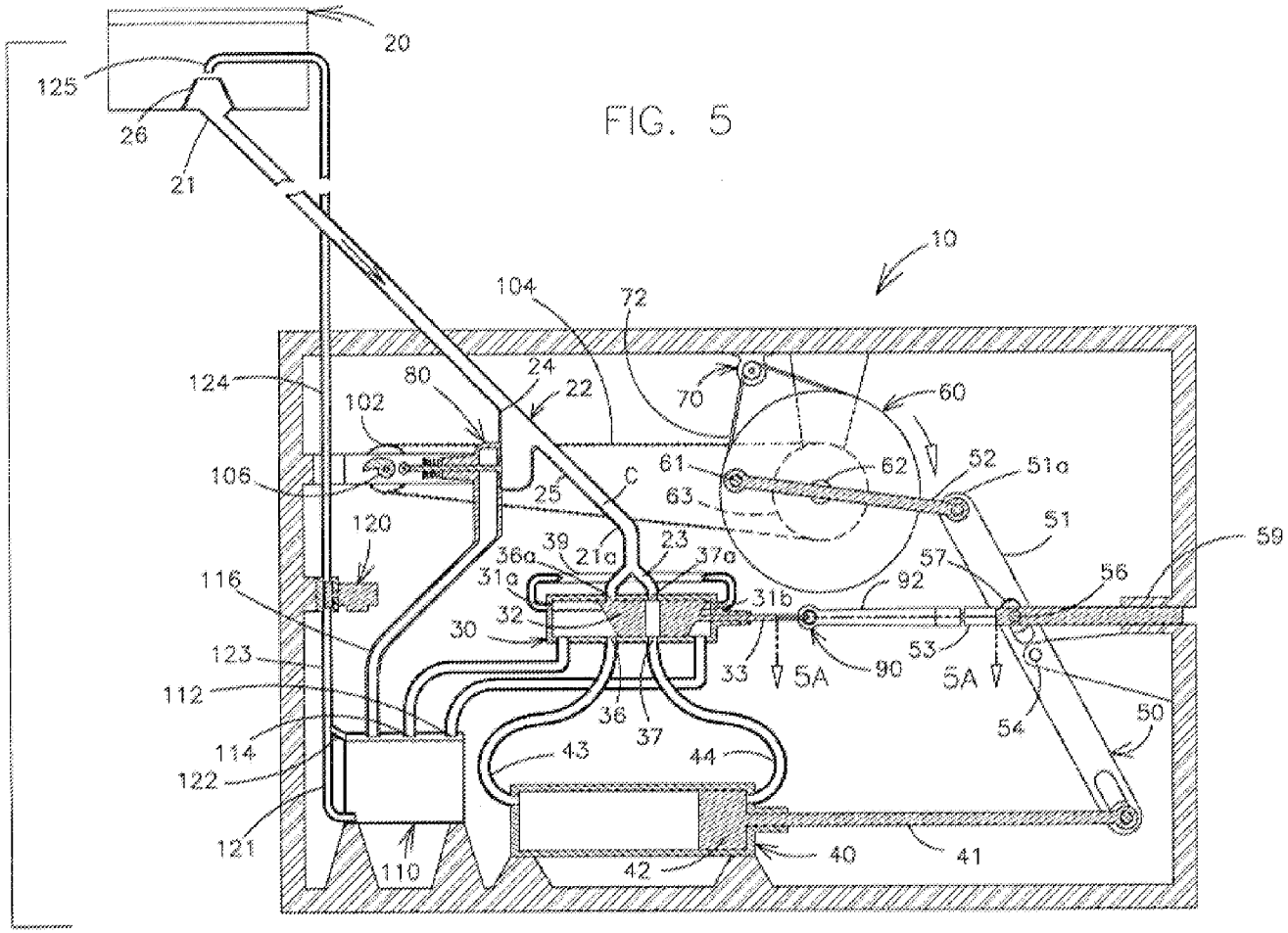
FIG. 5 shows an elevational cross-sectional view with pivoting lever member 51 having just passed the leftmost extreme position and ready to start moving clockwise towards the other extreme position. Spring mechanism 90 has been fired or dislodged from the coaxial alignment of spring members 94. Piston head 42 is shown at its rightmost extreme position ready to start traveling back to the leftmost position.
Figure 5A:
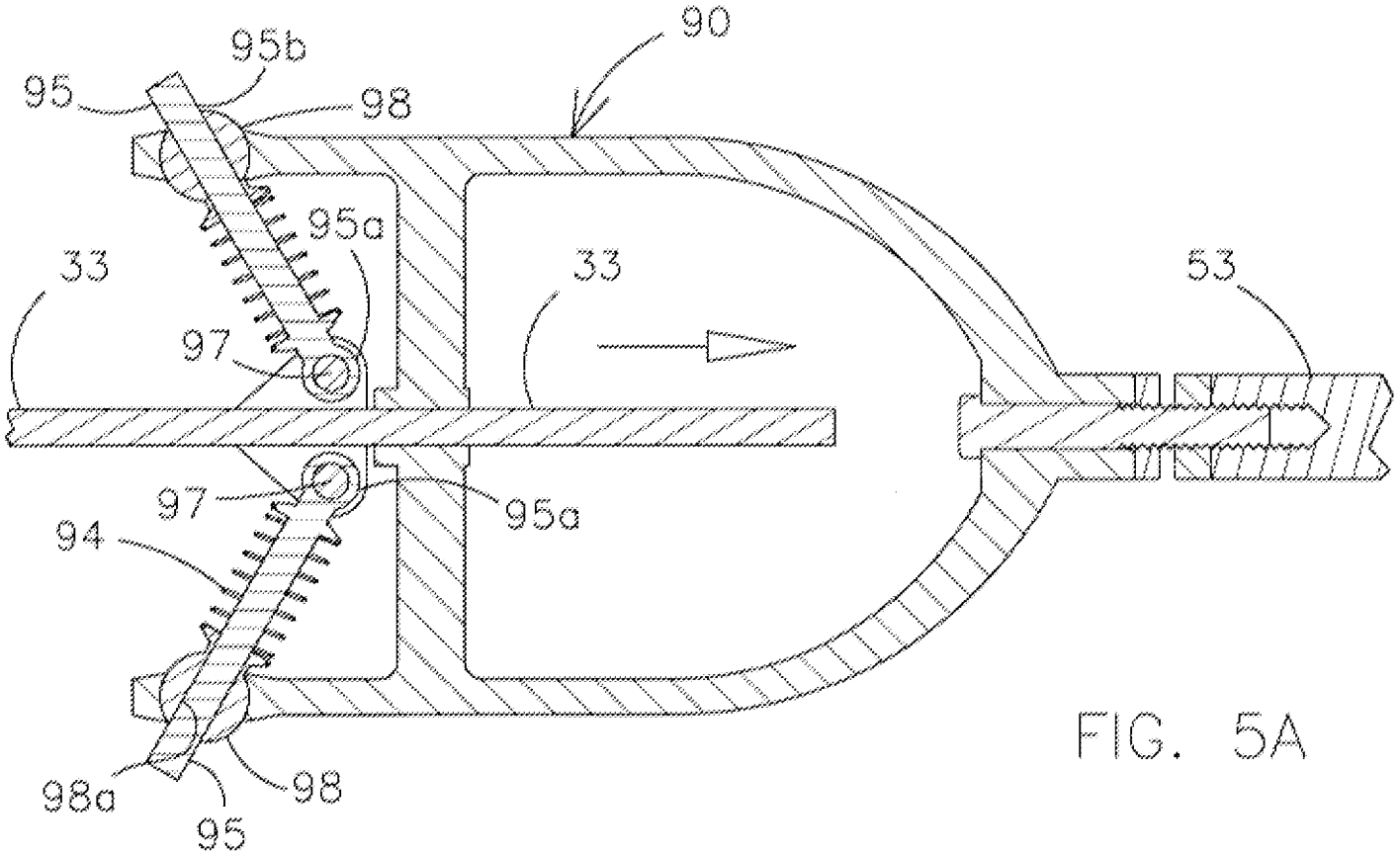
FIG. 5A is a cross-sectional view of spring mechanism 90 taken along line 5A-5A in FIG. 5 showing valve rod 33 moved to the right. At this point, spring mechanism 90 is not moving.
Figure 6:
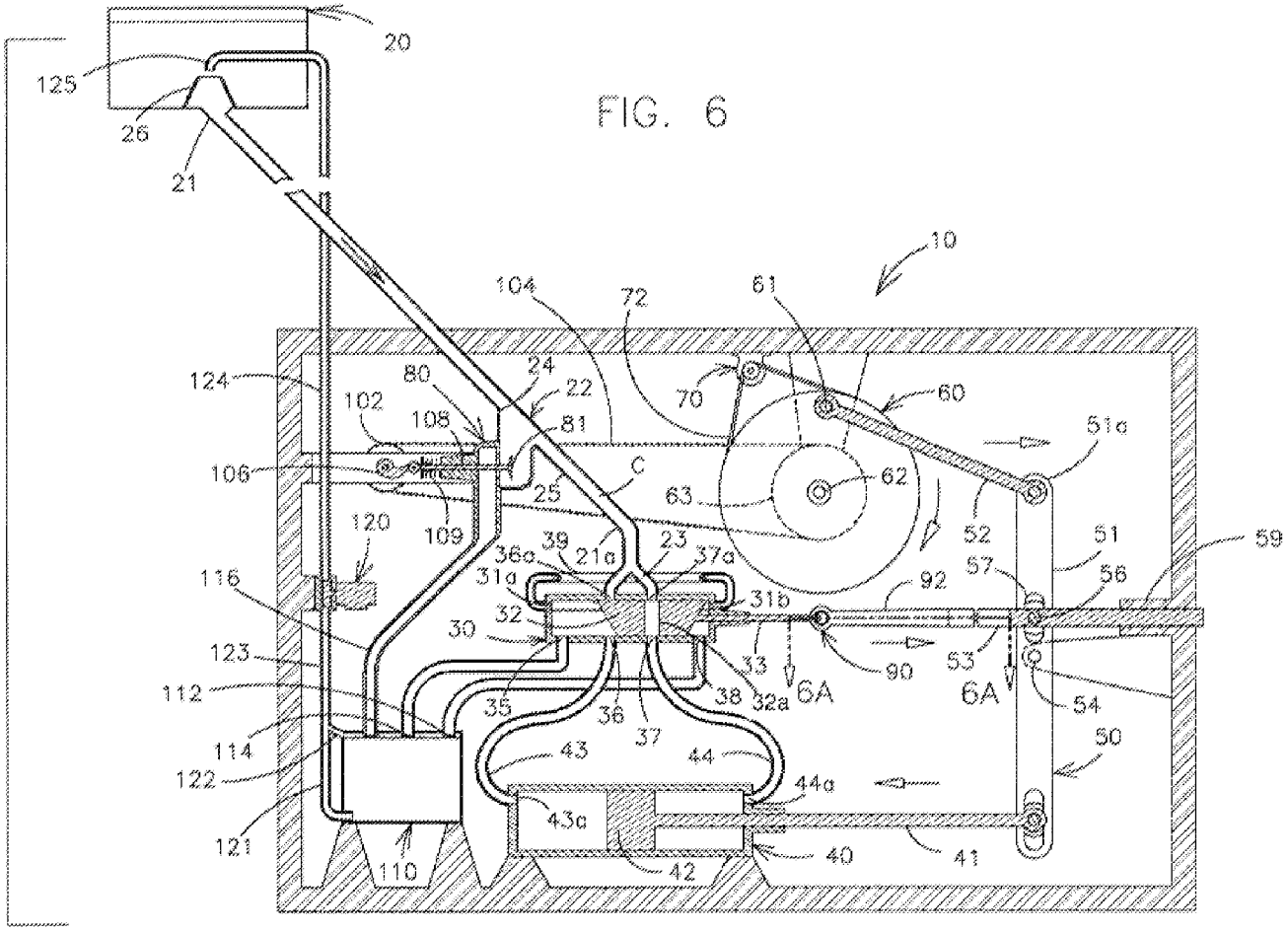
FIG. 6 shows an elevational cross-sectional view of the embodiment for the present invention shown in the previous figures with pivoting lever member 51 at a vertical position bringing linkage rod 52 to the right. Spring mechanism 90 is moving to the right, beginning to compress spring members 94.
Figure 6A:
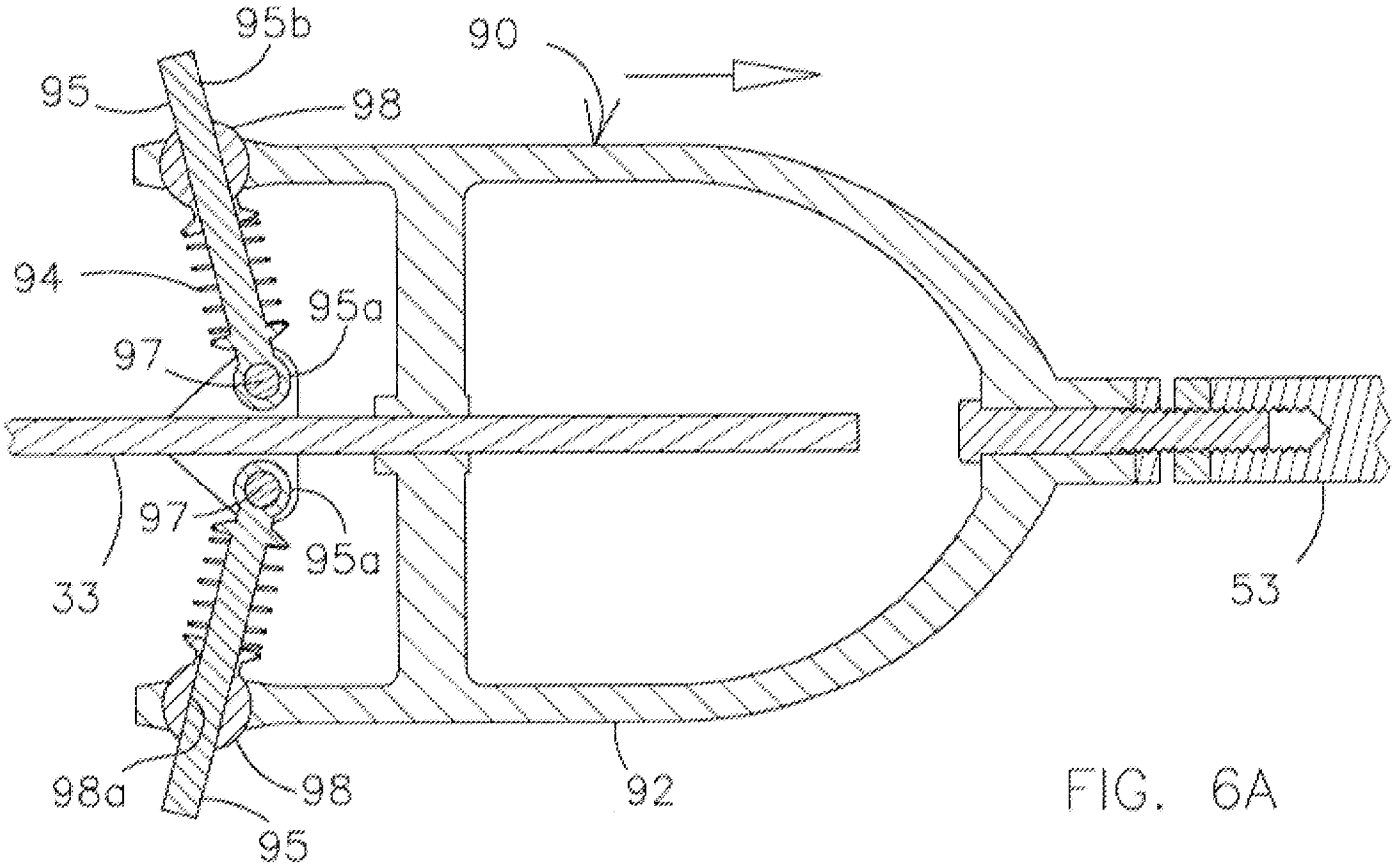
FIG. 6A is a cross-sectional view of spring mechanism 90 taken along line 6A-6A in FIG. 6. Rod 33 is not moving at this point.
Figure 7:
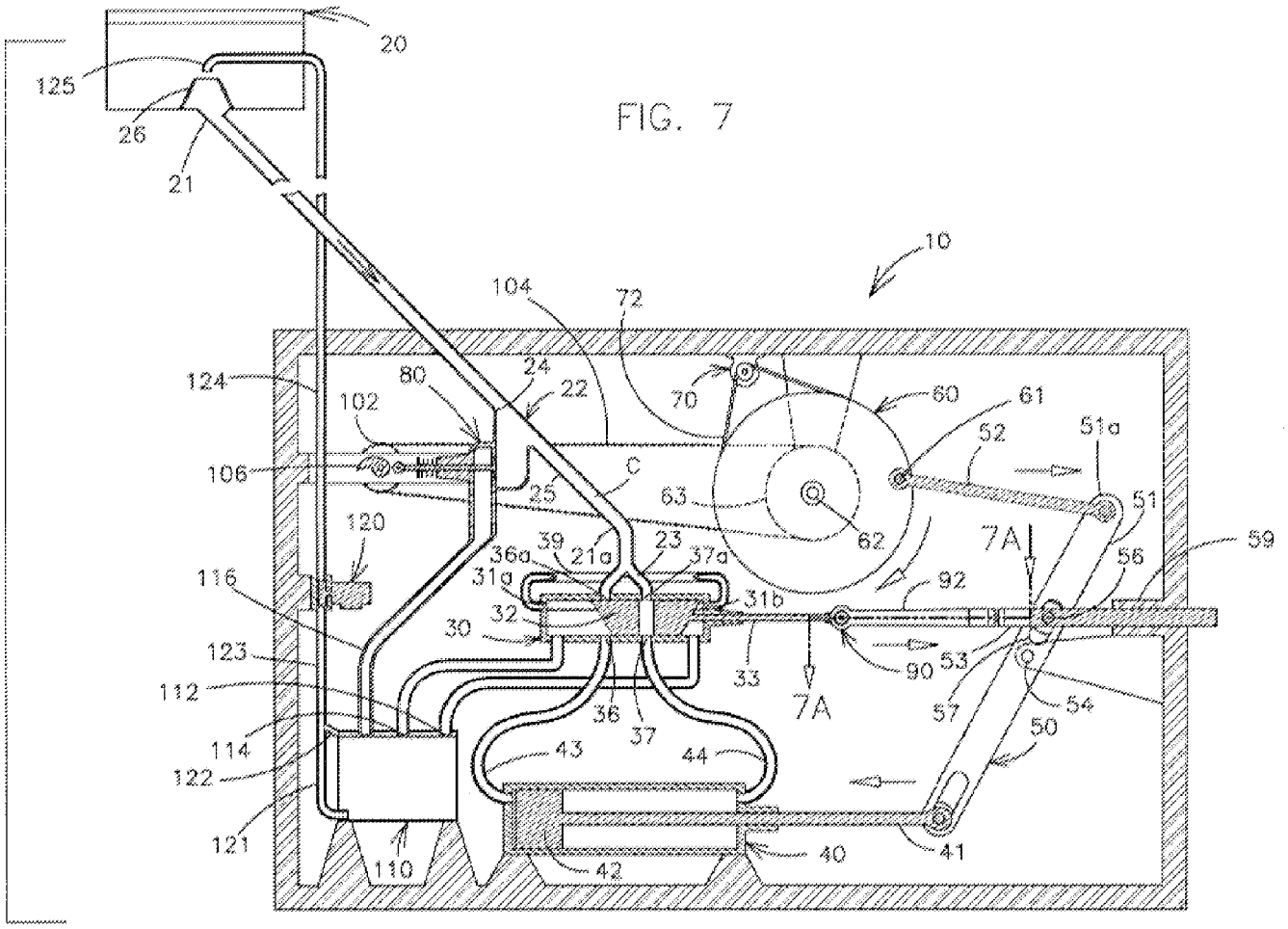
FIG. 7 shows an elevational cross-sectional view, as in the previous figure, with pivoting lever member 51 inclined to the right, almost reaching the other extreme position. Spring mechanism 90 is moving slowly to the right and spring members 94 have reached the compressed coaxial alignment position.
Figure 7A:
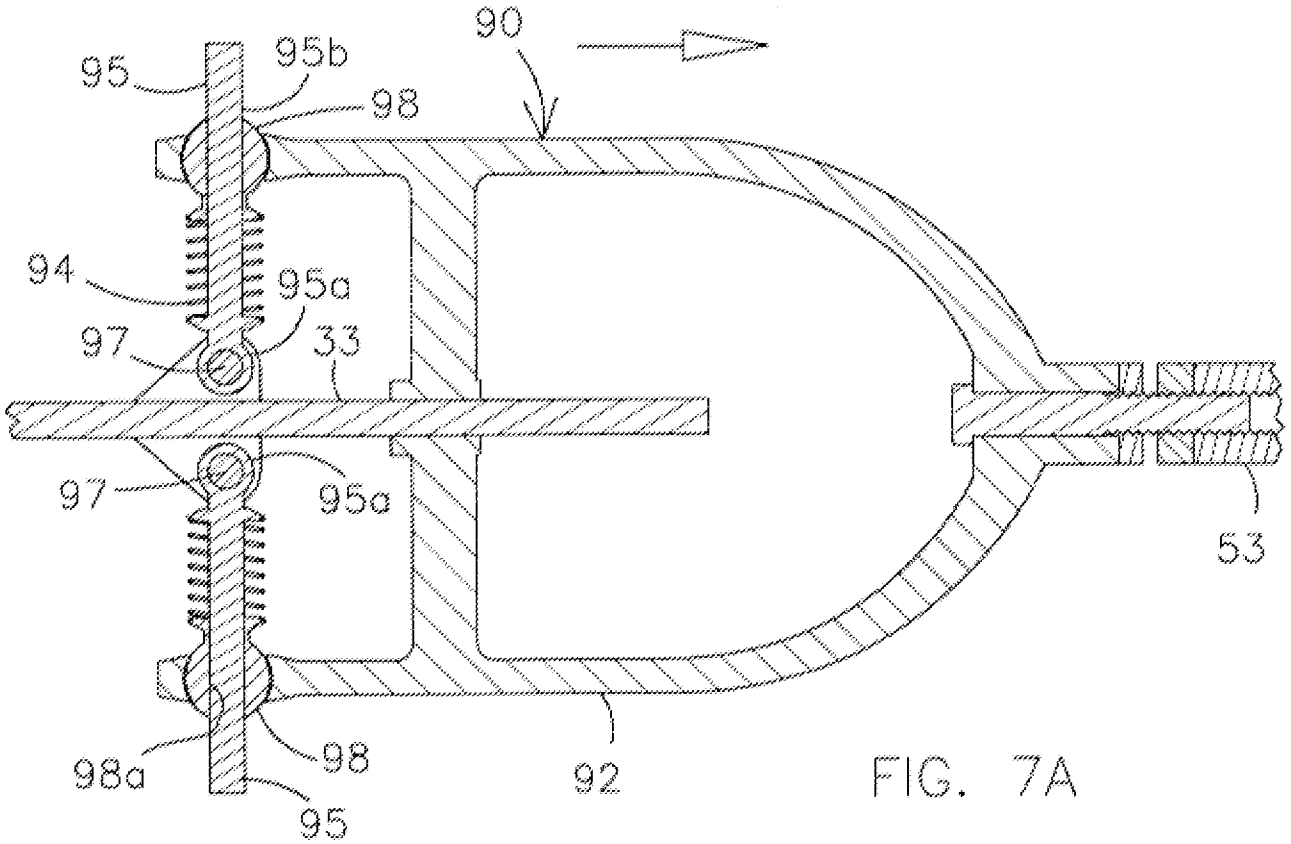
FIG. 7A is a cross-sectional view of spring mechanism 90 taken along line 7A-7A in FIG. 7. Rod 33 is not moving at this point.
Figure 8:
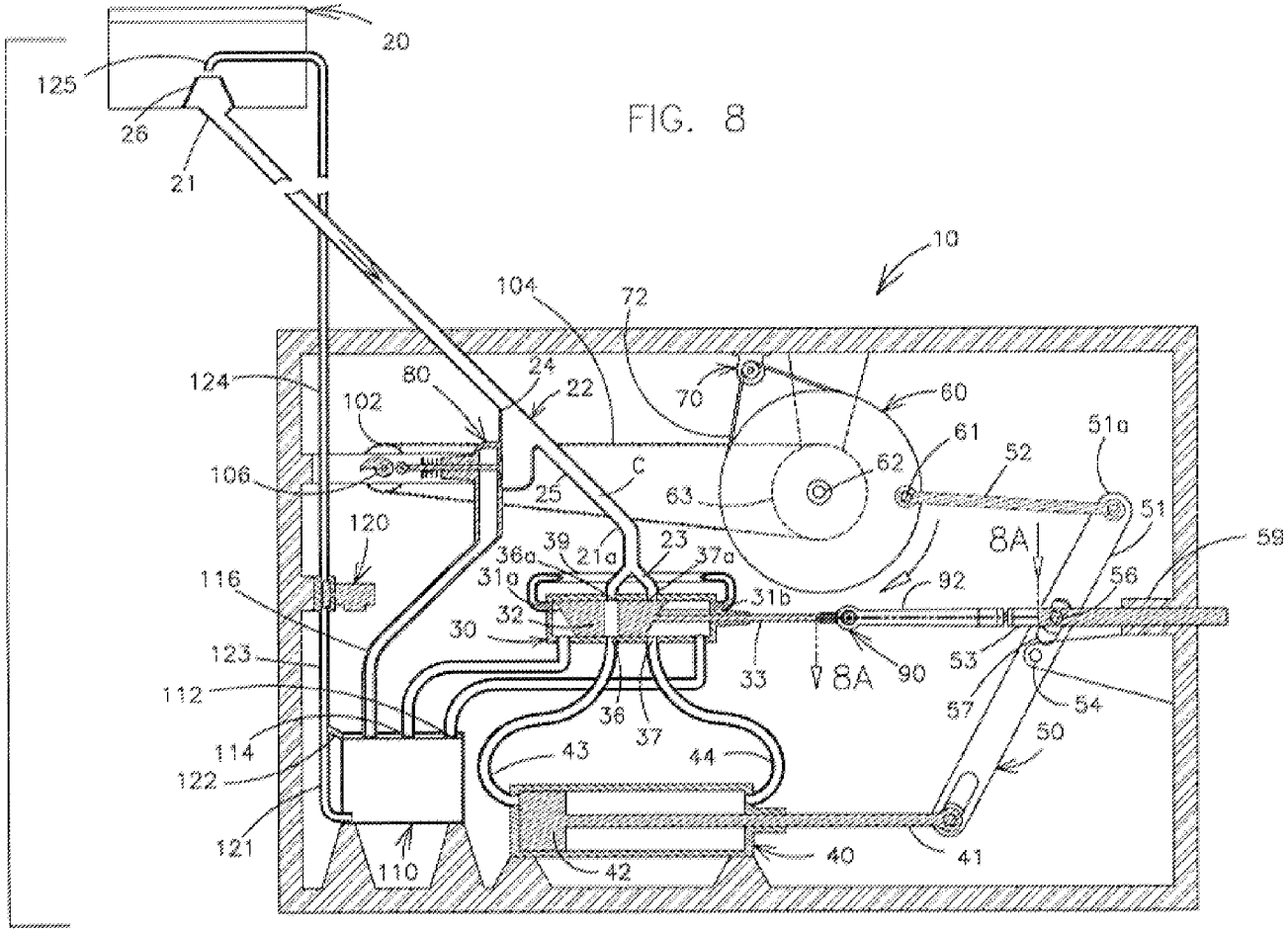
FIG. 8 shows an elevational cross-sectional view of the embodiment shown in the previous figures with pivoting lever member 51 at the extreme position (clockwise) and about to start moving counterclockwise. Rod 33 is drastically pushed to the left by spring members 94 being dislodged from their compressed coaxial position.
Figure 8A:
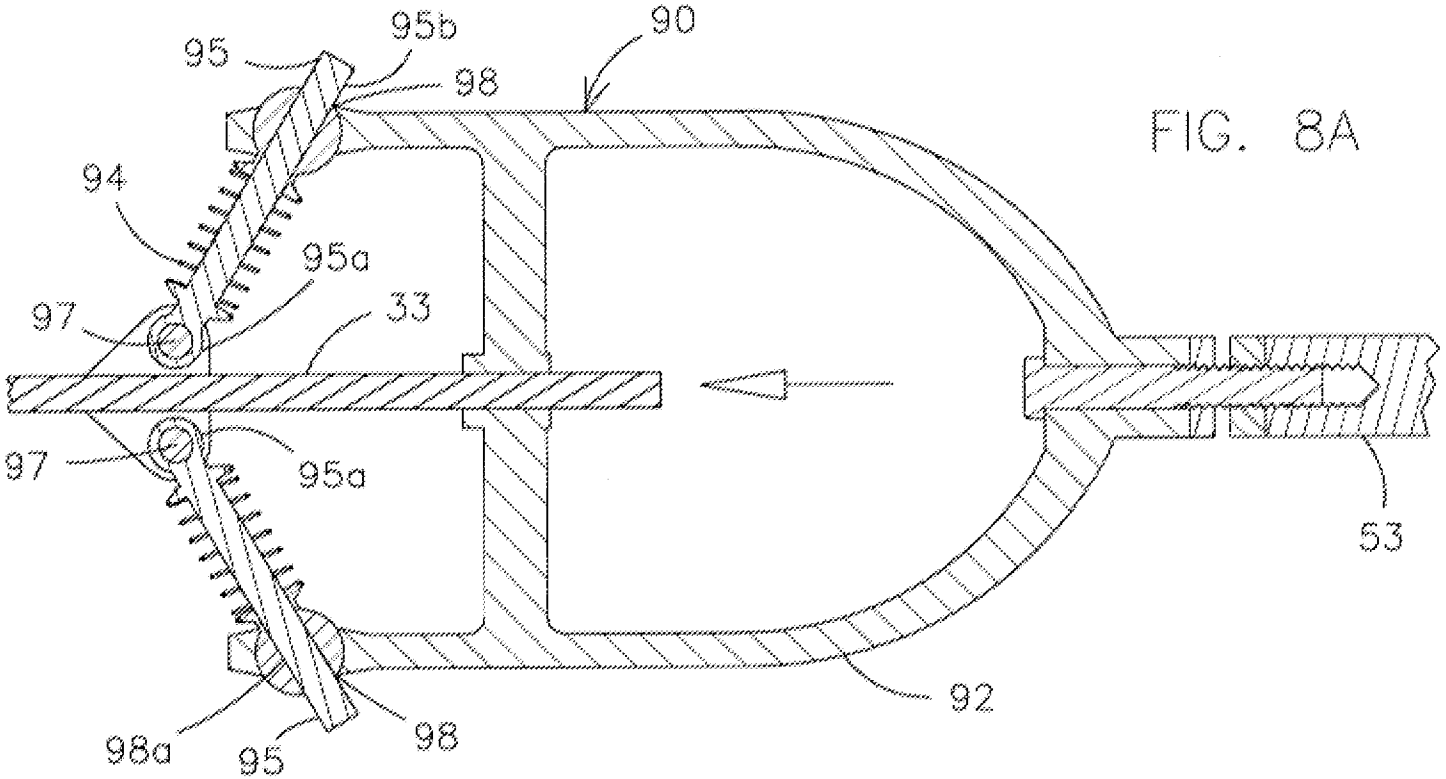
FIG. 8A is a cross-sectional view of spring mechanism 90 taken along line 8A-8A in FIG. 8.

Spring actuating mechanism 90 is shown in FIGS. 3A, 4A, 5A, 6A, 7A, and 8A. In FIGS. 3 and 3A, valve rod 33 is shown at the leftmost extreme position with fork portion 92 moving towards the left. In FIGS. 4 and 4A, fork portion 92 reaches its leftmost position, placing pivoting pin 95 in an unstable position by virtue of the bias action of spring member 94. Pivoting pin 95 journals transversal pin 97 at end 95*a* and the other end 95*b* passes through a central opening 98*a* of pivoting bushing 98. In FIGS. 5 and 5A, pivoting pins 95 have been rapidly dislodged from their coaxial alignment, pushing rod 33 drastically to the right, bringing valve member 32 to the right and aligning port 37*a* with port 37. In FIGS. 6 and 6A, fork portion 92 starts traveling to the right, urging pivoting pins 95 to come towards their coaxial alignment position. In FIGS. 7 and 7A, fork portion 92 has reached the rightmost position with pivoting pins 95 achieving their unstable coaxial alignment and being ready to be drastically dislodged. In FIGS. 8 and 8A, rod 33 was pushed towards the leftmost position, bringing valve member 32 also to the leftmost extreme position where ports 36*a* and 36 are aligned. This movement is constantly repeated, causing valve member 32 to periodically travel between the two extreme positions rapidly and staying a predetermined longer amount of time with the above-mentioned ports aligned than the traveling time.

Valve assembly 80 is caused to move rapidly between open and closed positions through valve actuating assembly 100 that is mechanically coupled to lever assembly 50 through sprockets 63 and 102 with chain 104 trained over them. Pawl 106 is rigidly mounted to sprocket 102 and rotates to progressively actuate valve rod 108 to cause valve assembly 80 to drastically (rapidly) close.

Figure 9:
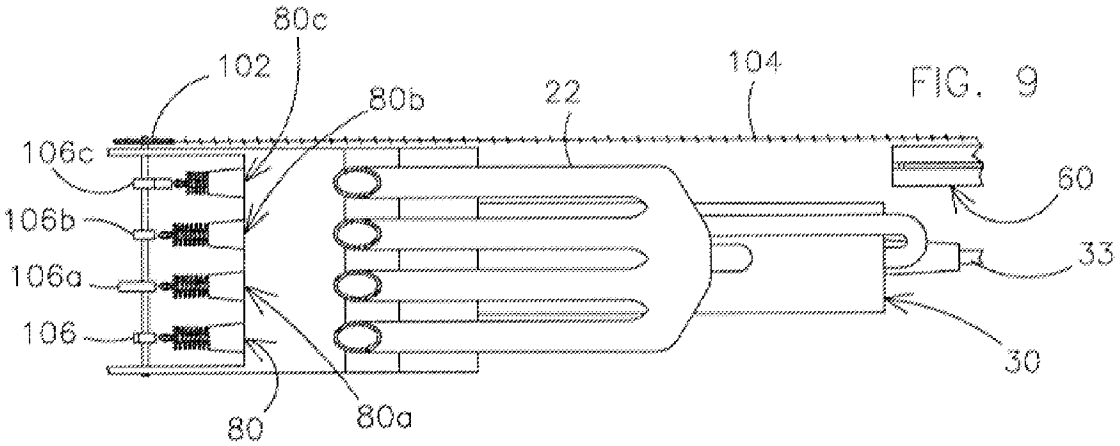
FIG. 9 is a partial top view of an alternate embodiment showing four valve actuating assemblies 100; 100*a*; 100*b*; and 100*c*.
Figure 9A:
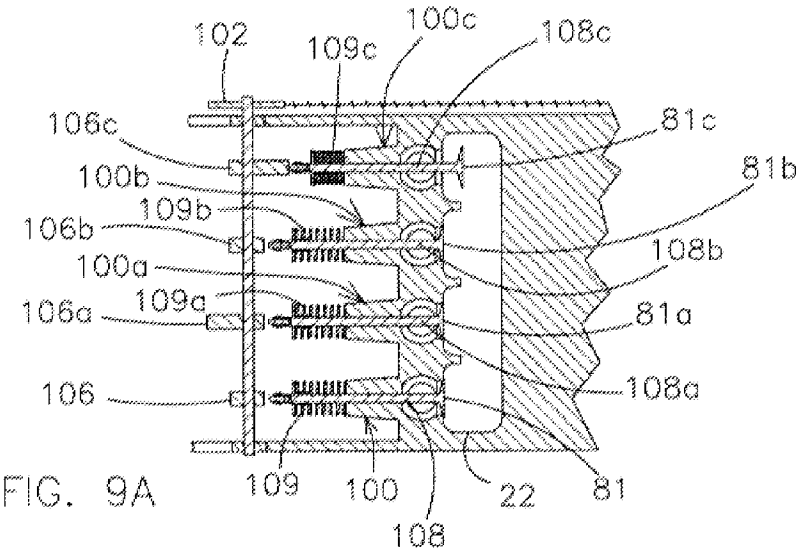
FIG. 9A is a partial cross-sectional view of the assemblies shown in the previous figure with spring 109*c* compressed as a result of the position of pawl 106*c*. The other springs 109; 109*a*; and 109*b* are in the expanded state due to the position of pawls 106; 106*a*; and 106*b*, respectively.

In one of the embodiments, a bank of several hydraulic shock valve assemblies 80 are connected in parallel. One of these embodiments contemplates four assemblies 80, as shown in FIGS. 9 and 9A. Sprocket 63 has a diameter that is twice as large as the diameter of sprocket 102. In this manner, one 360 degree rotation of sprocket 63 causes sprocket 102 to rotate twice as much. In FIGS. 9 and 9A, four actuating assemblies 100; 100*a*; 100*b*; and 100*c* include pawls 106; 106*a*; 106*b*; and 106*c* that are phased out 90 degrees so that each full rotation of sprocket 102 produces four hits or actuation of hydraulic shock valve assemblies 80; 80*a*; 80*b*; and 80*c* so that only one valve member 81; 81*a*; 81*b*; or 81*c* is open at a given time in the embodiment shown. Each valve member 81, 81*a*, 81*b*, and 81*c* is connected to valve rods 108, 108*a*, 108*b*, and 108*c* and biased by springs 109, 109*a*, 109*b*, and 109*c*, respectively.

To move piston rod 41 to the left position, a pressure (force) greater in magnitude than the pressure produced by the relatively small water column (between ports 36 and 43*a*; 37 and 44*a*) is needed, as shown in FIG. 4. This greater pressure is produced by water column C and by the hydraulic shock created by valve assembly 80 by repeatedly opening and closing, as seen in FIG. 3. The water in column C rushes through valve assembly 80 and through conduit 43 causing the potential energy of the water to partially transform into kinetic energy. A hydraulic shock effect is also produced when valve member 32 moves from the position in FIG. 3 suddenly to the position in FIG. 5. The resulting water hammer pressure is calculated as follows:

$$P_{wh}=[(0.070VL)/t]+P_i$$

wherein:

$P_{wh}$ is the pressure resulting from the water hammer effect;

V=change in velocity of the liquid in the conduit assembly;

L=upstream conduit assembly's length;

t=valve closing time;

$P_i$=pressure at rest (before hammer condition).

In FIG. 5, piston head 42 is shown about to start moving to the left to push the water inside piston assembly 40 out and into inlet/outlet port 36 of distribution valve assembly 30. The water then exits through outlet port 38 (and through inlet/outlet port 36 when moving to the right) and towards inlet port 114 (and into tank 110 through inlet port 112 when moving to the right) of holding tank 110. Connecting tube 39 interconnects the two ends of distribution valve assembly 30. The function of tube 39 is to facilitate the exit of the water accumulated at one end of assembly 30 to avoid resistance in the sudden movement of valve member 32, as seen in FIG. 6. Valve member 32 has, in this embodiment, slanted ends to clear ports 31*a*; 31*b*. In FIG. 7, valve member 32 is at the extreme left position with all the water having exited assembly 40.

The water collected in holding tank 110 is delivered to assembly 80 through conduit 116. Also, tank 110 is connected through conduits 121 and 122 to common conduit 123 and to pump assembly 120, which in turn is connected through conduit 124 to container assembly 20. Conduit 121 transports water collected in tank 110. Conduit 122 transports any air trapped in tank 110. In one of the embodiments, end 125 comes in proximity with inlet 26 of conduit assembly 22 in order to promote a Venturi effect.

The reciprocating movement of rod 41 causes pivoting lever member 51 to oscillate or pivot about point 54. Here a shaft or ball bearing member can be used to implement pivoting point 54. Pivot lever member 51 includes slot 57 that coacts with pin 56 transversally mounted to actuating rod 53 with one end slidably receivable within bushing 59. In this manner, the oscillating movement of pivoting lever member 51 is converted to a reciprocating movement of actuating rod 53. Additionally, linkage rod 52 is pivotally mounted adjacent to end 51*a* at one end and to point 61, which is off-centered on wheel assembly 60 so that the oscillating movement at end 51*a* is converted to a rotational movement of wheel assembly 60.

Wheel assembly 60 rotates about point 62 and includes, in the described embodiment, sprocket 63, which has chain 104 trained over it and over sprocket 102 to drive valve actuating assembly 100. Wheel assembly 60 has generator belt 72 trained over it to drive generator 70. A portion of the electricity produced by generator 70 is used to drive pump assembly 120.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hydraulic motor for generating electricity, comprising: a container assembly having a container inlet including a body of water and first conduit means with first and second ends, said first end connected to the lowermost point of said container assembly and said first conduit means further including a connecting port between said first and second ends and substantially adjacent to said second end with said second end being positioned at a predetermined distance below said container assembly, a hydraulic shock valve assembly connected to said connecting port and further including second conduit means having third and fourth ends with said third end connected to the lowermost point of said hydraulic shock valve assembly so that the water entering through said connecting port and passing through said hydraulic shock valve assembly is discharged through said second conduit means, a holding tank connected to said fourth end of said second conduit means at the uppermost area of said holding tank, said tank being positioned below said hydraulic shock valve assembly, said tank including first and second inlet ports and further including first and second outlet ports, said first outlet port being positioned on the uppermost area of said tank and said second outlet port being located on the lower side of said tank, a distribution valve assembly having a valve housing with first and second housing ends and having a moving valve member therein that moves between two extreme positions, said valve member including a transversal through opening, said distribution valve assembly including third and fourth inlet ports and a bifurcated tube connecting said third and fourth inlet ports to said second end and connected, respectively, to said first and second inlet ports of said tank, said distribution valve assembly being positioned below said hydraulic shock valve assembly and above said holding tank, and said distribution valve assembly including third and fourth outlet ports adjacent to said first and second housing ends, respectively, and further including first and second inlet/outlet ports in cooperative alignment with said third and fourth inlet ports for allowing said valve member to selectively interrupt the connection between said third inlet port with said first inlet/outlet port while connecting said fourth inlet port with said second inlet/outlet port when said moving valve member is at one extreme position and interrupting the connection between said fourth inlet port with said second inlet/outlet port while the connecting said third inlet port with said first inlet/outlet port when said moving valve member is at the other extreme position, and said distribution valve assembly further including a valve rod mounted to said valve member and being partially housed within said valve housing and extending centrally and outwardly through said first housing end, an actuating mechanism for said distribution valve assembly to cause said valve member to move rapidly between said two extreme positions of said valve assembly, said valve member mounted to said valve rod; a piston assembly including a piston housing with third and fourth housing ends and a piston head therein moveable between extreme first and second positions and further including third and fourth inlet/outlet ports connected to said first and second inlet/outlet ports, respectively, and said piston assembly further including a piston rod coaxially disposed with respect to said piston housing and partially extending centrally within said piston housing and protruding outwardly through said third housing end, an oscillating lever assembly having a pivoting lever member with first and second lever ends and pivoting about a central pivoting point with a slot between said pivoting point and said second lever end, said first lever end being mounted to said piston rod distal end to receive the reciprocating movement transmitted by said piston rod, and further including a linkage rod with first and second linkage rod ends, said first linkage rod end being pivotally mounted to said pivoting lever member adjacent to said second lever end, and said lever assembly further including an actuating rod that extends substantially transversally and adjacent to said lever member with a perpendicularly mounted pin that cooperatively engages with said slot, and said actuating rod mounted to said actuating mechanism, a wheel assembly pivotally receiving said second linkage rod end at an off-centered location on said wheel assembly and in cooperative combination to convert the oscillatory movement of said second lever end to a rotational movement of said wheel assembly, and said wheel assembly including means for transmitting said rotational movement to a valve actuating assembly for driving said hydraulic shock valve assembly to cause it to repetitively open and close to deliver a shock to said first conduit means, an electric generator assembly coupled to said wheel assembly to receive the rotational movement necessary to generate electricity, and electric pump means powered by said generator assembly, said pump means having an inlet connected to said first and second outlet ports of said holding tank and an outlet connected to said container inlet in said container assembly.

2. The hydraulic motor set forth in claim 1 wherein said valve actuating assembly includes a spring biased valve rod and a coacting pawl member for periodically activating said hydraulic shock valve assembly in response to the movement of said wheel assembly.

3. The hydraulic motor set forth in claim 2 wherein said actuating mechanism includes a reciprocating moving fork portion slidably and coplanarly receiving said valve rod, and further including at least one spring biased pin having first and second pin ends, said first pin end being pivotally mounted to said for portion and said second pin end being pivotally mounted to said valve rod thereby causing said valve rod to quickly move between two extreme positions.

4. The hydraulic motor set forth in claim 1 wherein said actuating mechanism includes a reciprocating moving fork portion slidably and coplanarly receiving said valve rod, and further including at least one spring biased pin having first and second pin ends, said first pin end being pivotally mounted to said for portion and said second pin end being pivotally mounted to said valve rod thereby causing said valve rod to quickly move between two extreme positions.

5. The hydraulic motor set forth in claim 1 wherein said valve actuating assembly includes a spring biased valve rod and a coacting pawl member for periodically activating said hydraulic shock valve assembly in response to the movement of said wheel assembly.

* * * * *